United States Patent [19]

Shuert

[11] Patent Number: 4,879,956

[45] Date of Patent: Nov. 14, 1989

[54] PLASTIC PALLET

[76] Inventor: Lyle H. Shuert, 817 N. Fieldstone, Rochester, Mich. 48063

[21] Appl. No.: 144,419

[22] Filed: Jan. 14, 1988

[51] Int. Cl.[4] ..... B65D 19/38

[52] U.S. Cl. ..... 108/53.3; 108/52.1; 108/901

[58] Field of Search ..... 108/53.3, 53.1, 52.1, 108/901, 902, 53.5, 55.5; 206/600, 599

[56] References Cited

U.S. PATENT DOCUMENTS

| | | | |
|---|---|---|---|
| 2,486,284 | 10/1949 | Horwitz | 108/52.1 X |
| 3,467,032 | 9/1969 | Rowlands et al. . | |
| 3,561,375 | 6/1968 | Hammond . | |
| 3,636,888 | 1/1972 | Angelbeck, Jr. . | |
| 3,664,271 | 5/1972 | Wolder et al. . | |
| 3,667,403 | 6/1972 | Angelbeck, Jr. | 108/901 X |
| 3,680,496 | 8/1972 | Westlake, Jr. . | |
| 3,757,704 | 9/1973 | Allgeyer et al. | 108/901 X |
| 3,868,915 | 3/1975 | Hafner . | |
| 3,993,168 | 11/1976 | Kubick | 108/53.1 |
| 4,013,020 | 3/1977 | Schoeller et al. | 108/901 X |
| 4,279,204 | 7/1981 | Propst | 108/53.3 |
| 4,397,247 | 8/1983 | Lemelson | 108/57.1 |
| 4,403,555 | 9/1983 | Forrest | 108/51.1 |
| 4,428,306 | 1/1984 | Dresen et al. | 108/53.3 |
| 4,606,278 | 8/1986 | Shuert | 108/901 X |

*Primary Examiner*—Kenneth J. Dorner
*Assistant Examiner*—Jose V. Chen
*Attorney, Agent, or Firm*—Krass & Young

[57] ABSTRACT

A plastic pallet of twin sheet construction formed in a vacuum thermal forming process. The upper sheet includes a series of downwardly extending hollow upwardly opening bosses arranged in staggered rows and the lower sheet includes a series of upwardly extending hollow downwardly opening bosses generally corresponding in size, number, shape and distribution pattern to the downwardly extending bosses on the upper sheet. The lower walls of the downwardly extending bosses are fused to the upper walls of the upwardly extending bosses in the thermal forming process so as to form a series of vertical columns extending between the upper and lower sheets and maintaining the sheets in fixed spaced relation. The pallet further includes a plurality of legs spaced circumferentially about the periphery of the pallet and depending downwardly from the pallet. Each of the legs is formed of a downwardly extending portion of each of the sheets and forms an upwardly opening pocket opening in the upper face of the upper surface of the upper sheet to allow nesting of the pallet with other pallets of similar construction.

11 Claims, 3 Drawing Sheets

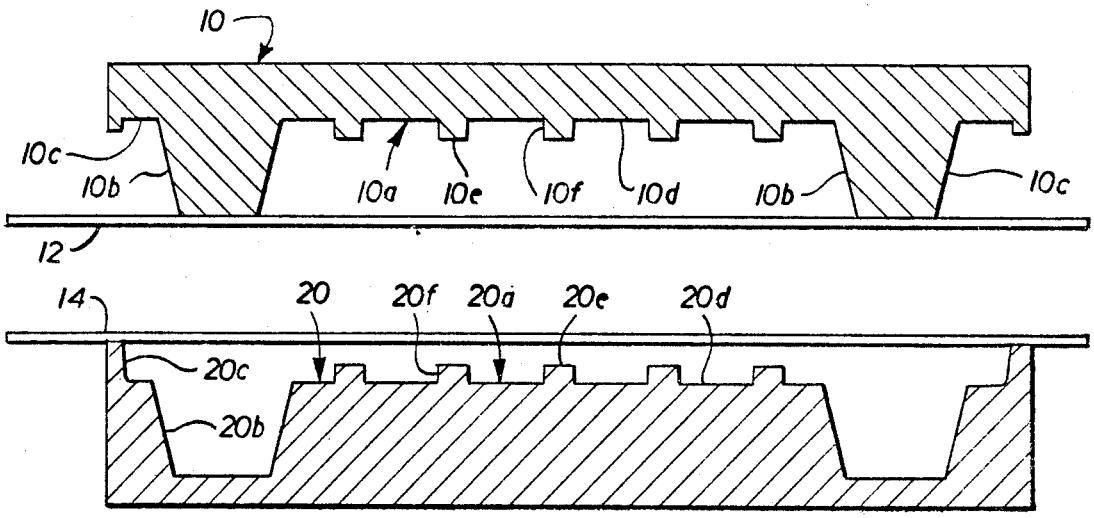
FIG. 1
FIG. 2
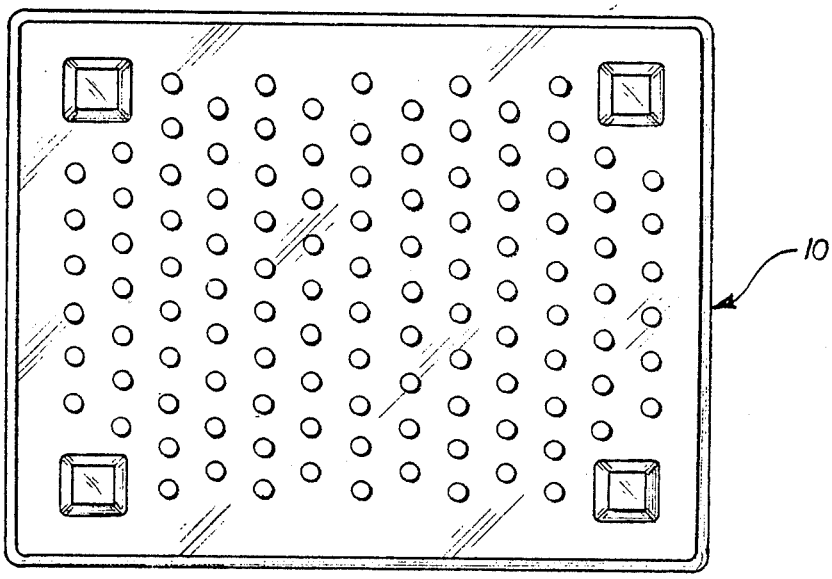
FIG. 3
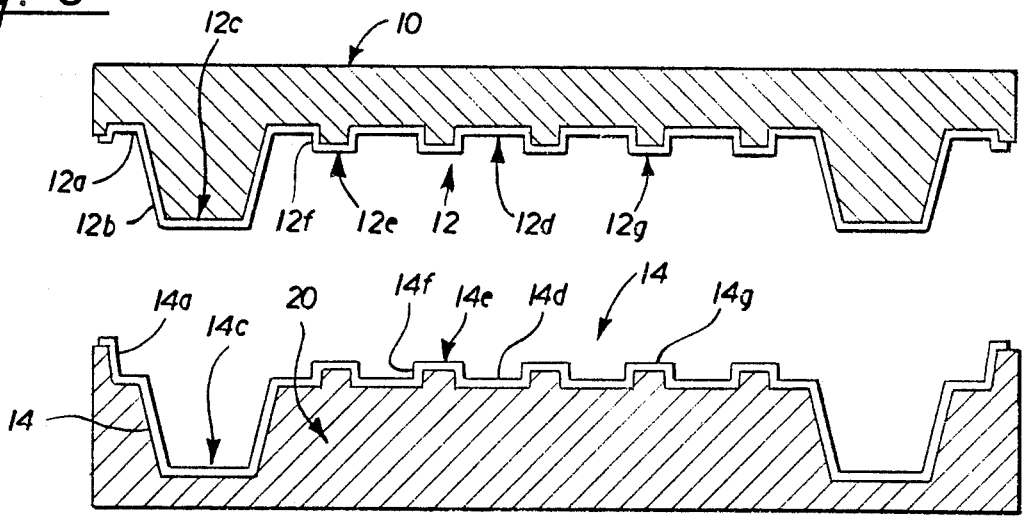

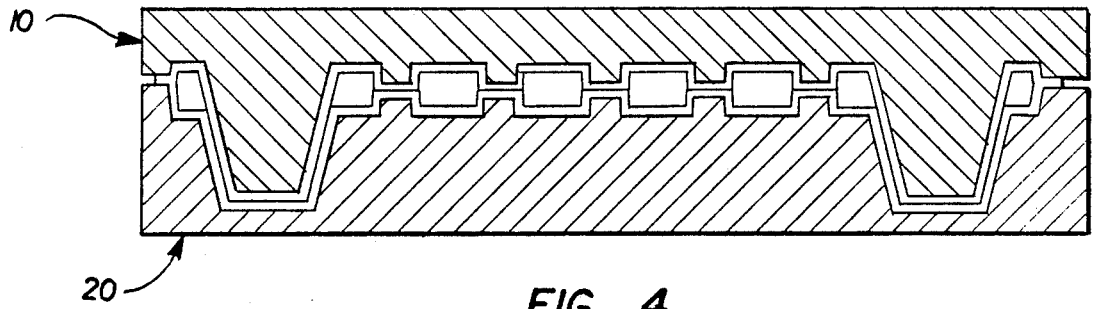
FIG. 4
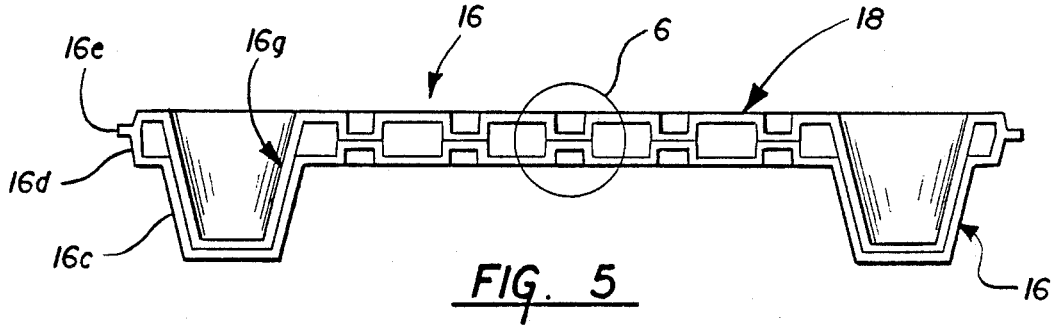
FIG. 5
FIG. 6
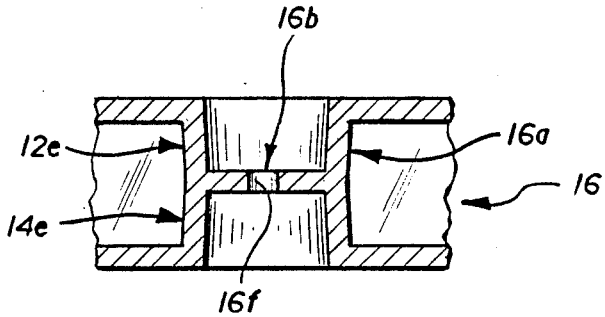
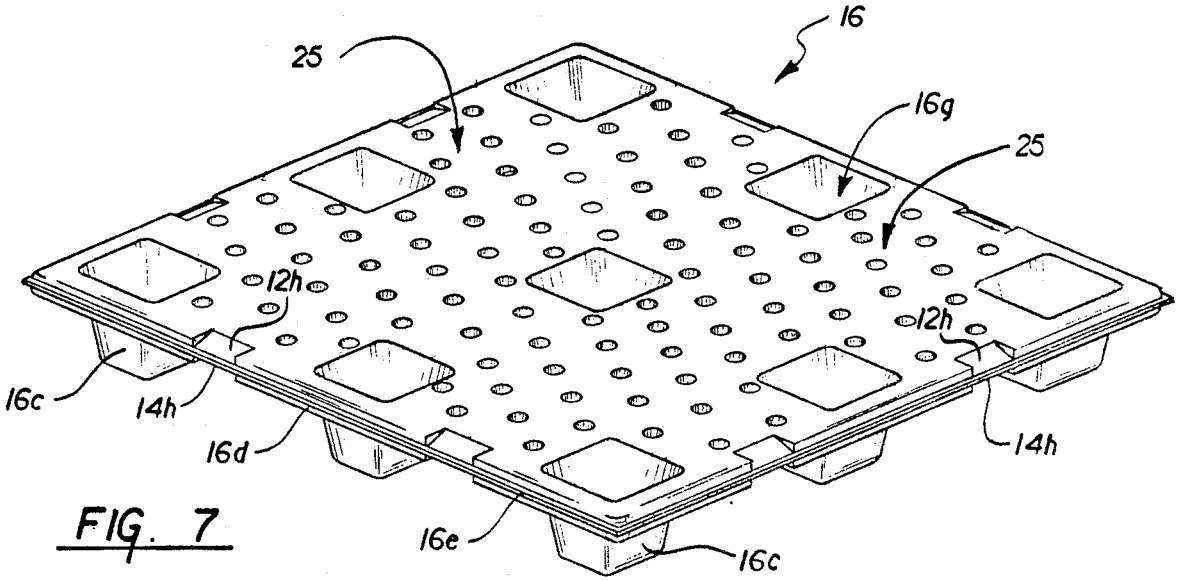
FIG. 7

PLASTIC PALLET

BACKGROUND OF THE INVENTION

This invention relates to shipping and storage pallets and more particularly to plastic pallets embodying a twin sheet construction.

Pallets have traditionally been formed of wood. Wood pallets, however, have many disadvantages. For example, they are subject to breakage and thus are not reusable over an extending period of time. Wood pallets also take up a considerable amount of valuable floor space in the warehouse when they are not in use. In an effort to solve some of the problems associated with wood pallets, plastic pallets have been developed and employed with some degree of success. In one generally successful form of plastic pallet design, upper and lower plastic sheets are formed in separate molding operations and the two sheets are then selectively fused or knitted together in a suitable press to form a reinforced double wall or "twin sheet" structure. In one popular twin sheet construction, a plurality of parallel linearly extending upwardly opening channels are provided in the upper sheet and a like plurality of parallel linearly extending downwardly opening channels are provided in the lower sheet with the upper and lower channels angled with respect to each other and fused or knitted together at their interfaces. These twin sheet plastic pallets, although substantially more durable than the wooden pallets that they replace, tend to have a substantially higher initial cost than the corresponding wooden pallets due in large part to the relatively high cost of the raw plastic material required to form the pallet. It is therefore critical that the twin sheet type of pallet embody a structural design that maximizes the structural strength of the pallet for a given amount of plastic material employed to form the pallet.

SUMMARY OF THE INVENTION

This invention relates to a plastic pallet of the twin sheet design which provides extremely high structural strength for a given amount of plastic material employed.

According to the invention, the invention plastic pallet includes an upper, generally flat plastic sheet having a series of downwardly extending hollow upwardly opening protuberances with the remainder of the upper surface of the sheet between the protuberances planar; and a lower generally flat plastic sheet having a series of upwardly extending hollow downwardly opening protuberances, generally corresponding in size, number, shape and distributional pattern to the downwardly extending protrusions. The bottom wall portion of each downwardly extending protuberance is fused to the top wall portion of the respective upwardly extending protuberance to form integral solid wall portions at the interface of each downwardly and upwardly extending protuberance so as to position the sheets in fixed parallel relation to each other to define a substantially planar load bearing platform member. This arrangement of fused together downwardly and upwardly extending protuberances provides rigid vertical columns between the upper and lower sheets and creates an overall truss effect so as to maximize the structural strength of the pallet for a given amount of raw plastic material employed to fabricate the pallet.

According to a further feature of the invention, the pallet further includes a plurality of legs spaced circumferentially about the periphery of the load bearing platform member and depending downwardly from the load bearing member to elevate the load bearing member above a support surface by a distance to allow the entry of the fork members of a lift truck; and each of the legs is formed as a downwardly extending portion of each of the sheets forming an upwardly opening pocket opening in the upper face of the load bearing platform member to allow nesting of the pallet with other pallets of similar construction. This arrangement allows fork liftable and nestable pallets embodying the invention construction to be readily and inexpensively formed.

According to a further feature of the invention, the protuberances comprise bosses having generally cylindrical side walls so as to each coact with the mating boss to form a generally cylindrical column extending vertically between the upper and lower sheets. This specific cylindrical boss construction has been found to maximize the strength of the pallet for a given weight of plastic material.

According to a further feature of the invention, the bosses are arranged in parallel rows on each sheet with the bosses in one row staggered with respect to the bosses in the adjacent row. This specific staggered arrangement further augments the high structural strength of the pallet.

The invention also embodies a method of forming a plastic pallet. The invention method includes the steps of heat forming an upper plastic sheet to provide a series of downwardly extending hollow upwardly opening protuberances; heat forming a lower plastic sheet to provide a series of upwardly extending hollow downwardly opening protuberances corresponding in size, number and distributional pattern to the downwardly extending protuberances on the first sheet; with the sheets in a hot flowable state, positioning the sheets with the bottom walls of the downwardly extending protuberances juxtaposed to the top walls of the upwardly extending protuberances; and, with the sheets still in a hot flowable state, pressing the sheets together to fuse the protuberance bottom walls to the protuberance top walls to form a series of continuous, vertical columns between the sheets, each comprising a downwardly extending upwardly opening protuberance, an upwardly extending downwardly opening protuberance, and a fused central horizontal partition. This method provides an inexpensive and efficient means of providing an extremely high strength pallet of twin sheet construction.

According to a further feature of the invention method, the heat forming, with respect to each sheet, further includes providing a plurality of downwardly extending legs spaced circumferentially about the periphery of the respective sheet and each forming an upwardly opening pocket on the interior thereof; the positioning step includes positioning the downwardly extending legs on the upper sheet nestingly within the downwardly extending legs on the lower sheet; and the pressing step includes fusing portions of each leg of the upper sheet to portions of the corresponding leg of the lower sheet so as to form legs including integral solid wall portions formed of fused together portions of both of the sheets. This methodology provides an inexpensive and effective means of providing a high structural strength fork liftable and nestable pallet.

BRIEF DESCRIPTION OF THE DRAWINGS

FIG. 1 is a diagrammatic cross-sectional view of a pair upper and lower molds utilized to form the invention pallet;

FIG. 2 is a bottom view of the upper mold of FIG. 1;

FIG. 3 is a view of the molds of FIG. 1 following the thermal vacuum forming of the upper and lower sheets;

FIG. 4 is a view of the molds of FIG. 1 showing the manner in which the thermally formed sheets are brought together to form the invention pallet;

FIG. 5 is a view of the pallet formed utilizing the molds of FIG. 1;

FIG. 6 is an enlarged fragmentary view of the portion of the invention pallet within circle 6 of FIG. 5;

FIG. 7 is a perspective view of a commercial embodiment of the invention pallet;

DETAILED DESCRIPTION OF THE PREFERRED EMBODIMENT

Figure 8:
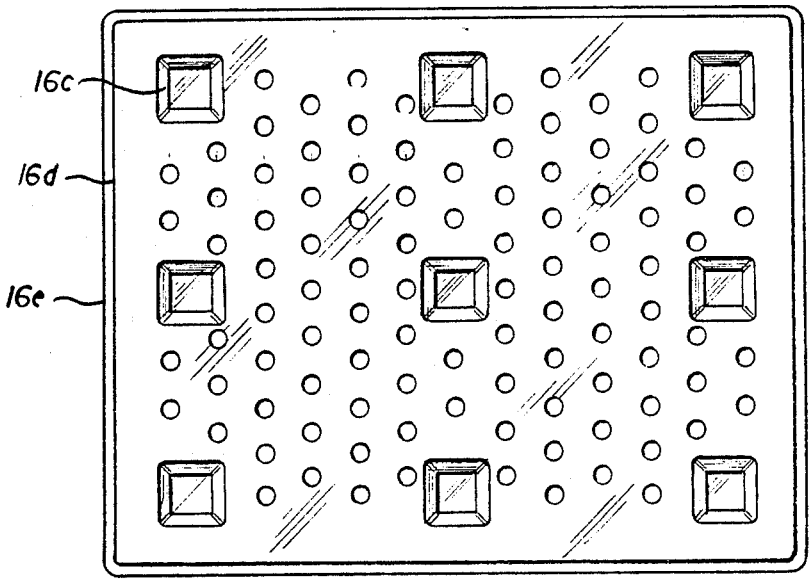
FIG. 8 is a bottom view of the pallet of FIG. 7.

The upper and lower molds 10 and 20 seen in FIGS. 1–4 are shown somewhat diagrammatically and each include a molding surface 10*a*,20*a* against which the respective plastic sheet is formed in a thermal vacuum process. It will be understood that means, not shown, are provided in each mold to form a vacuum along the molding surface so as to pull the respective heated sheet inwardly against the molding surface in a vacuum forming process.

Molding surface 10*a* of upper mold 10 includes a plurality of leg portions 10*b*, spaced circumferentially about the periphery of the mold, a rim portion 10*c*, a planar undersurface 10*d*, and a plurality of protuberances or boss portions 10*e* projecting downwardly from the planar undersurface 10*d*. Upper mold 10 is generally rectangular and bosses 10*e* are arranged in staggered rows, as seen in FIG. 2. The side walls 10*f* of bosses 10*e* are generally cylindrical but may have a slight draft angle to facilitate the molding process.

The molding surface 20*a* of lower mold 20 includes leg portions 20*b*, a peripheral portion 20*c*, an upwardly facing planar main body surface 20*d*, and a plurality of upwardly extending protuberances or boss portions 20*e* having generally cylindrical side wall portions 20*f*. Bosses 20*f* are arranged in staggered rows and correspond in size, number, shape and distributional pattern to downwardly extending bosses 10*e* on upper mold.

In the use of the molds 10 and 20 to form the invention pallet, flat upper and lower plastic sheets 12 and 14 are heated in an oven to a formable temperature, heated upper plastic sheet 12 is positioned beneath upper mold 10, and heated lower plastic sheet 14 is positioned above lower mold 20. Sheets 12 and 14 are preferably formed of an organic polymeric material such as polyethylene. Following positioning of the heated sheets 12 and 14 below and above the respective molds, vacuum is applied to molding surfaces 10*a* and 20*a* to allow the sheets to be sucked upwardly and downwardly into conforming relationship to molding surfaces 10*a* and 20*a*, as seen in FIG. 3.

The upper sheet 12, following the vacuum molding process, includes a peripheral portion 12*a*; a plurality of circumferentially spaced leg portions 12*b* each defining an upwardly opening pocket 12*c*; a planar main body portion 12*d*; and a series of downwardly extending hollow upwardly opening bosses 12*e* having generally cylindrical side walls 12*f*.

The lower sheet 14, following the vacuum molding process, includes a peripheral portion 14*a*; a plurality of circumferentially spaced leg portions 14*b* each defining an upwardly opening pocket 14*c*; a planar main body portion 14*d*; and a series of downwardly extending hollow upwardly opening bosses 14*e* having generally cylindrical side walls 14*f*.

As previously noted, and as best seen in FIG. 2, the bosses 12*e* and 14*e* are arranged in parallel staggered rows and the area between the bosses is totally flat and totally uninterrupted except for the legs. The parallel staggered row arrangement provides a repeating pattern of five bosses arranged in an X configuration with a boss at each corner of the X and a further boss at the intersection of the X. The number and cross-sectional area of the bosses may be chosen, for example, so as to produce upper and lower sheets in which the cumulative area of the bosses is approximately 10% of the total surface area of the sheets so that, in the areas of the sheets where the bosses are provided, approximately 90% of the sheet surfaces are flat.

Following the vacuum forming of upper and lower sheets 12, 14, molds 10 and 20 are brought together, with the sheets still in a heated flowable state, to juxtapose portions of the upper sheet to corresponding portions of the lower sheet, as seen in FIG. 4. Specifically, the lower walls 12*g* of the bosses 12*e* are juxtaposed to the upper walls 14*g* of the bosses 14*e* and the lower ends of legs 12*b* are nestingly positioned within the corresponding legs 14*b*. Following the bringing together of the molds to the positions seen in FIG. 4, the molds are pressed together by the use of suitable external pressing mechanism to cause the juxtaposed portions of the upper and lower sheets to fuse or knit together to produce the pallet 16 seen in FIG. 5.

In the pallet 16, the upper walls 14*g* of bosses 14*e* are fused or knitted together with the lower walls 12*e* of bosses 12*e* to form a series of vertical columns 16*a* arranged in staggered rows and each comprising a downwardly extending upwardly opening boss 12*e*, an upwardly extending downwardly opening boss 14*e*, and a fused or knitted together central horizontal partition 16*b* formed as a fusion of a respective lower wall 12*e* and a respective upper wall 14*e*. The legs 12*b* of the upper sheet also fuse or knit with the legs 14*b* of the lower sheet to form the legs 16*c* of the pallet and the peripheral portions 12*a* and 14*a* of the upper and lower sheets fuse or knit together to form a peripheral vertical edge structure 16*d*, including an external peripheral lip 16*e*, extending around the outer periphery of the pallet and closing the space between the upper and lower sheets around the entire periphery of the pallet. Whereas the walls of the upper legs 12*b* are shown as fusing over their entire interface area with the walls 14*b* of the lower sheet, in actuality the fusion as between the interfaced surfaces of the upper and lower leg wall portions would preferably be selective with certain portions of the upper leg fused to corresponding portions of the lower leg and certain portions of the upper leg spaced from the corresponding portions of the lower leg.

In the completed pallet, the column 16*a* coact with main body planar portions of the upper and lower sheets 12,14 to form a substantially planar load bearing platform structure 18 having the legs 16c extending downwardly therefrom to elevate the load bearing platform structure 18 above a support surface by a distance sufficient to allow the entry of the forks of a forklift truck. At least certain of the partitions 16b of the columns 16a are provided with a central aperture 16f to lighten the pallet, reduce the amount of plastic material required to form the pallet, and provide drainage as between the upper and lower regions of the pallet.

Figure 9:
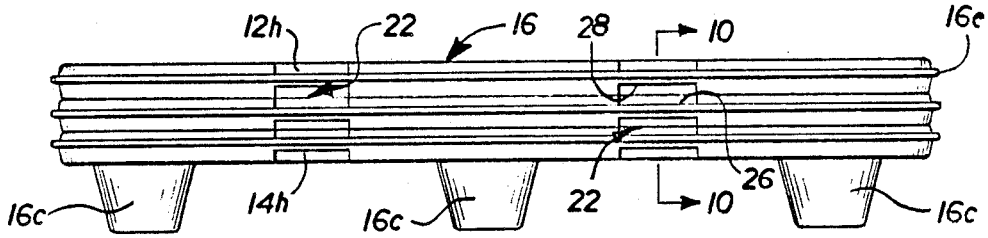
FIG. 9 is a view showing a plurality of invention pallets in a stacked, nested disposition.

A preferred commercial form of pallet according to the invention is seen in FIGS. 7 and 8 wherein nine legs 16c are provided with eight of the legs positioned circumferentially about the periphery of the pallet and the ninth leg positioned centrally of the pallet and with each leg 16c defining an upwardly opening pocket 16g opening in the upper face of the pallet for nesting receipt of the legs of a similarly constructed pallet. The legs are designed to provide total nesting of the pallet so that, with the pallets stacked as seen in FIG. 9, the platform structure 18 of one pallet is contiguous with the platform structure 18 of the adjacent pallets in the stack. As further seen in FIGS. 7 and 8, the columns 16a are arranged in parallel rows with the columns in each row staggered with respect to the columns in the adjacent row. The number, spacing and dimensions of the columns, as well as the spacing between the upper and lower sheets and the thickness of the sheets, will of course vary depending upon the particular structural requirements of each pallet but, as previously noted, adequate pallet strength may be provided for most applications by the provisions of columns having openings in the flat surfaces of the pallet representing only about 10% of the total surface area, leaving about 90% of the pallet surface area in a totally flat configuration to facilitate loading of material on the pallet. For example, for a pallet having overall dimensions of 48 inches by 40 inches, the upper and lower sheets may have a starting thickness of ⅛ inch and may be spaced in the completed pallet by approximately 2 inches; the openings of the columns in the flat platform surfaces may have a diameter of approximately 1 inch; the openings in a given row may be spaced center to center by a distance of approximately 3 inches; and adjacent rows may be spaced center to center by a distance of 2½ inches. The columns are provided in a tightly packed pattern in all major areas of the pallet platform structure not occupied by the legs. Specifically, as best seen in FIG. 7, all major portions of the platform structure, including the edge portions 25 between each successive pair of leg openings 16g, include a plurality of columns arranged in a plurality of rows so as to define a tightly packed pattern of columns in all major portions of the platform structure.

Figure 10:
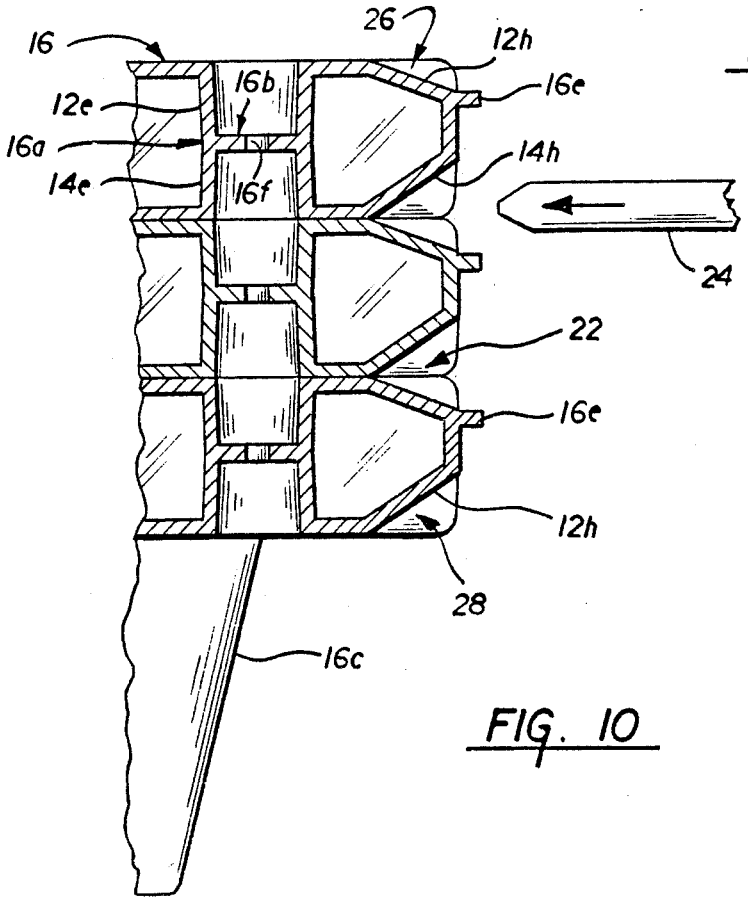
FIG. 10 is a fragmentary cross-sectional view taken on line 10—10 of FIG. 9.

The invention also includes means to facilitate lifting of the pallets by a forklift truck with the pallets in a nested, stacked configuration, as seen in FIGS. 9 and 10. Specifically, a pair of upper ramp surfaces 12h are provided along each side edge of upper sheet 12 with each upper ramp surface positioned midway between a pair of adjacent legs 12c, and a pair of lower ramp surfaces 14h are provided along each side edge of lower sheet 14 with each lower ramp surface positioned midway between a pair of adjacent legs 14c. In the completed pallet 16, each upper ramp surface 12h extends from the upper face of the platform structure 18 downwardly and outwardly to open in edge structure 16d above peripheral lip 16e whereby to form a series of circumferentially spaced and upwardly opening notches 26 in edge structure 16d, and each lower ramp surface 14h extends from the lower face of platform structure 18 upwardly and outwardly to open in edge structure 16d below peripheral lip 16e whereby to form a series of circumferentially spaced and downwardly opening notches 28 in edge structure 16d. Upper ramp surfaces 12h and notches 26, coact with corresponding lower ramp surfaces 14h and notches 28, in the stacked configuration of the completed pallets to define a pair of wedge-shaped pockets 22 along each side edge of the stacked pallets and between each pair of stacked pallets with the pockets positioned between the nested legs 16c of the pallets. The slope of each ramp 12h is shallower than the slope of each ramp 14h since ramps 12h are limited in their downward sloping extent by the peripheral lip 16e of the pallet so that each pocket 22 includes a relatively large upper volume defined by a ramp surface 14h and a relatively small lower volume defined by a ramp surface 12h. Pockets 22 provide a target for the forklift truck operator when it is desired to remove one or more pallets from the stack; facilitate the entry of the forks 24 of the forklift truck between the stacked pallets; and ensures that the forks will enter between the stacked pallets between the nested legs of the pallets so as to avoid damage to the nested pallet legs by the intruding forks 24.

Pallets constructed in accordance with the invention design have been found to have superior structural strength as compared to the prior art twin sheet pallets utilizing other knitted or fused configurations as between the upper and lower sheets. For example, as compared with the popular prior art twin sheet pallet in which a plurality of linearly extending upwardly opening channels are provided in the top sheet and a like plurality of parallel linearly extending downwardly opening channels are provided in the bottom sheet with the upper and lower channels angled with respect to each other and knitted at their interfaces, the invention boss and column design enables the invention pallet to be constructed utilizing at least one third less material than the described prior art twin sheet design while providing the same structural strength. Since the plastic material constitutes a significant part of the cost of a twin sheet pallet, a one third reduction in the amount of material required to meet any particular structural requirements enables the entire pallet to be manufactured at a cost significantly less than pallets of the described prior art twin sheet design.

Whereas the particular plastic material utilized to form the invention pallet is not critical, it has been found that excellent results may be obtained by the use of a high density polyethylene having a density of approximately 0.950 grams per cubic centimeter. The extremely high strength produced by the invention configuration results from the fact that the vertical columns formed by the fused together bosses coact with the planar main body portions of the upper and lower sheets to form a truss configuration for the load bearing structure 18 and this truss configuration in turn allows the weight of plastic material to be substantially reduced as compared to prior art twin sheet designs for a given strength requirement.

Whereas a preferred embodiment of the invention has been illustrated and described in detail, it will be apparent that various changes may be made in the disclosed embodiment without departing from the scope or spirit of the invention.

I claim:

1. A plastic pallet comprising:

(A) an upper generally flat polygonal plastic sheet having an upper surface and having a series of downwardly extending hollow upwardly opening protuberances each opening in said upper surface of said sheet and having a bottom wall portion;

(B) a lower generally flat polygonal plastic sheet having a series of upwardly extending hollow downwardly opening protuberances generally corresponding in size, number, shape and distribution pattern to said downwardly extending protuberances and each having a top wall portion;

(C) said bottom wall portion of each downwardly extending protuberance being fused to said top wall portion of the respective upwardly extending protuberance to form integral solid wall portions at the interface of each downwardly and upwardly extending set of protuberances so as to position said sheets in fixed parallel spaced relation to each other to define a substantially planar polygonal load bearing platform structure, said load bearing structure having an upper face;

(D) said pallet further including a plurality of legs spaced circumferentially about the periphery of said load bearing member and depending downwardly from said load bearing platform structure to elevate said platform structure above a support surface by a distance to allow the entry of forklifts;

(E) each of said legs being formed of a downwardly extending portion of each of said sheets and forming an upwardly opening pocket opening in the upper face of said load bearing member structure to allow nesting of said pallet with other pallets of similar construction;

(F) said protuberances comprising bosses having generally cylindrical side walls so as to each coact with the matching boss to form a generally cylindrical column extending vertically between said upper and lower sheets;

(G) said bosses being arranged in generally parallel rows on each sheet with each row, except where interrupted by said pockets, extending from a location proximate a first edge of said platform structure to a location proximate a second edge of said platform structure opposite said first edge;

(H) said bosses being substantially equally spaced along each row for the entire length of each row;

(I) said rows being substantially equally spaced and extending from a first row proximate a third edge of said platform structure to a final row proximate a fourth edge of said platform structure opposite said third edge;

(J) the distance between successive bosses in each row and the distance between adjacent rows being selected to provide a plurality of bosses between adjacent pocket openings as measured between said first and second edges as well as measured between said third and fourth edges so as to form a series of tightly spaced columns between said sheets in all major areas of said platform structure not occupied by said legs.

2. A pallet according to claim 1 wherein:

(K) said bosses in one row are staggered with respect to said bosses in an adjacent row so that a pattern of five bosses is arranged in an X configuration with a boss at each corner of the X and a further boss at the intersection of the X.

3. A pallet according to claim 1 wherein:

(K) the entire upper surface of said upper sheet between said leg pockets and said protuberances is flat and uninterrupted so as to form a flat planar load bearing surface at the upper surface of said platform structure.

4. A plastic pallet comprising:

(A) a flat upper plastic sheet having an upper and lower surface;

(B) a flat lower plastic sheet;

(C) a series of vertical generally tubular columns extending between said upper and lower sheets and coacting with said sheets to form a generally planar load bearing platform structure with said sheets maintained in fixed parallel spaced relation by said columns, the upper surface of said upper sheet forming a flat upper surface of said platform structure, and each of said columns opening in the flat upper surface of said platform structure; and (D) a series of legs extending downwardly from said platform structure at circumferentially spaced locations around the periphery thereof to elevate said load bearing platform structure above a support surface by a distance sufficient to allow the entry of the forks of a forklift truck;

(E) said legs being hollow and forming upwardly opening pockets opening in the flat upper surface of said platform structure to allow nesting of said pallet with other pallets of similar construction;

(F) said columns being provided in a substantially uniform dense pattern over substantially the entire upper surface area of said platform structure except where said surface area is interrupted by said upwardly opening leg pockets;

(G) a plurality of said columns being provided between each adjacent set of upwardly opening leg pockets so as to form a tightly spaced series of columns between said sheets in all major areas of said platform structure not occupied by said legs.

5. A pallet according to claim 7 wherein:

(H) said pallet further includes a vertical edge member extending totally around the periphery of said pallet and closing the space between said sheets around the periphery of the pallet.

6. A pallet according to claim 4 wherein:

(H) said upper surface of said upper sheet between the openings of said columns and the openings of said leg pocket is totally flat and uninterrupted so as to form a substantially flat planar load bearing surface.

7. A pallet according to claim 4 wherein:

(H) said dense pattern comprises at least five columns per square foot of said entire upper surface area.

8. A pallet according to claim 7 wherein:

(I) said dense pattern comprises parallel staggered rows of columns with the columns in each row spaced approximately three inches apart and adjacent rows spaced approximately two and one-half inches apart.

9. A plastic pallet comprising:

(A) a generally planar, rectangular platform structure having a vertical peripheral edge extending totally around said platform structure said edge defining four sides of said structure;

(B) a plurality of hollow legs extending downwardly from platform structure at circumferentially spaced locations about the periphery of said platform structure and each defining an upwardly opening pocket for nesting receipt of the legs of another pallet of similar construction; and (C) means defining ramp surfaces at circumferentially spaced locations around the periphery of said platform structure opening in said vertical peripheral edge to define at least two notches spaced from each other in each said side to facilitate the entry of the forks of a forklift truck between stacked pallets.

10. A pallet according to claim 9 wherein said platform structure has an upper face and a lower face and wherein:

(D) each of said ramp surfaces comprises an upper ramp surface extending from the upper face of said platform structure downwardly and outwardly to open in said vertical edge and define an upwardly opening notch in said vertical edge; and (E) a lower ramp surface is provided adjacent each upper ramp surface extending from the lower face of said platform structure upwardly and outwardly to open in said vertical edge, and defines a downwardly opening notch in said vertical edge, beneath the corresponding upper ramp surface so that, when stacked with pallets of similar construction, each upper ramp surface coacts with a lower ramp surface on the overlying pallet to define a pocket for receipt of the forks of a forklift truck and each lower ramp surface coacts with an upper ramp surface on the underlying pallet to define a pocket for receipt of the forks of a forklift truck.

11. A pallet according to claim 10 wherein:

(F) said ramp surfaces are defined between said legs so that said pockets on the stacked pallets are positioned between the nested legs of the stacked pallets.

* * * * *